United States Patent [19]

Hill

[11] Patent Number: 4,466,301

[45] Date of Patent: Aug. 21, 1984

[54] LOW PROFILE PUMPJACK UNIT

[76] Inventor: Johnny E. Hill, 3215 Apperson, Midland, Tex. 79701

[21] Appl. No.: 291,925

[22] Filed: Aug. 11, 1981

[51] Int. Cl.[3] ..... F04B 47/02

[52] U.S. Cl. ..... 74/41; 74/108

[58] Field of Search ..... 74/41, 108

[56] References Cited

U.S. PATENT DOCUMENTS

| | | | |
|---|---|---|---|
| 689,147 | 12/1901 | Vogt | 74/41 |
| 1,307,243 | 6/1919 | Cousins | 74/108 |
| 1,612,886 | 1/1927 | Sams | 74/108 |
| 2,071,437 | 2/1937 | Searle | 74/41 |
| 2,286,153 | 6/1942 | Nicolescu | 74/41 |
| 2,456,531 | 12/1948 | Patterson | 74/41 |
| 2,515,360 | 7/1950 | Vail | 74/41 |
| 2,877,652 | 3/1959 | Muschalek | 74/41 |
| 4,092,872 | 6/1978 | McClure | 74/41 |

*Primary Examiner*—Lawrence J. Staab
*Attorney, Agent, or Firm*—Marcus L. Bates

[57] ABSTRACT

A low profile pumpjack unit for producing fluid from a borehole. The pumpjack unit has a main frame supported below ground level. An upright Sampson post is supported by the main frame. A walking beam is journaled to the upper end of the Sampson post. A pitman arm is connected to and drives one end of the walking beam, while a horsehead is attached to the other end. The horsehead has a pair of curved tracks formed on the outermost surface thereof, each of which describes a segment of a circle, with the circle having a radius drawn from the Sampson post journal. The segment has a diagonal which is slightly shorter than the length of the stroke imparted into the sucker rod. The tracks abruptly curve at each end thereof to form the upper and lower ends of the horsehead. A cable bridle is received by an inside part of the horsehead, with the marginal ends of the bridle being maintained in aligned relationship respective to the two tracks which form the aforesaid circumference. The low profile of the pumpjack unit enables it to be maintained at a very low elevation which is easily hidden from view, and enables traveling irrigation systems to drive over the pumpjack unit.

4 Claims, 4 Drawing Figures

LOW PROFILE PUMPJACK UNIT

BACKGROUND OF THE INVENTION

Once upon a time pumpjack units were installed wherever needed with little or no regard to animal and plant life which had to co-exist therewith. The pumpjack units seldom were painted, crude oil escaping from packing boxes contaminated the immediate area, and if someone or some animal happened to walk or drive into the massive operating machinery, they were admonished and told that they should exercise greater caution. Occasionally, when a pumpjack unit was located directly on a school yard, or in the middle of a street, the owners occasionally would fence off the pumpjack unit as a feeble gesture of their concern over the mechanical monster they had imposed upon society.

But times are changing, and nowadays it is not unusual for pumpjack units to be neatly painted, surrounded by a protective fence, and the leakage from the packing boxes and piping greatly reduced or almost eliminated.

There are many occasions where the physical size of a pumpjack unit is objectionable to the immediate environment. For example, where the borehole has been formed near parks, in recreational facilities, and in crowded areas such as cities and towns, and more especially in a field of vegetation which is irrigated by a traveling irrigation system. It is not always the visual observation of the pumpjack unit which is objectionable, because some pumpjack units are a work of art and a beauty to behold; rather, it is the interference of the monster respective to the conduct of our daily lives.

In an irrigation field, which utilizes a traveling irrigation system, the presence of any tall obstruction, such as a pumpjack unit, prevents the irrigation system from making a complete circle or cycle. In these instances, it has heretofore been necessary for the downhole pump to be actuated by apparatus other than a pumpjack unit because the extreme elevation of the Sampson post, walking beam, and horsehead prevented the traveling irrigation system from passing over the pumpjack unit.

In a pumpjack unit, as the pitman arm is reciprocated by the crank, the walking beam is oscillated or rocked about the Sampson post bearing, causing the horsehead to move within an arc having a radius drawn from the Sampson post bearing.

The outermost side of the horsehead is configurated into a segment of a circle which coincides with the arc drawn by the horsehead when oscillatory motion is imparted thereinto by the walking beam, so that the bridle cable supported by the circumferentially extending part of the track located on the outermost side of the horsehead is moved vertically. This complex motion causes the hanger bar located on the lower end of the cable to be stroked in a vertical plane and along the longitudinal axial centerline of the borehole. In the prior art, it is customary to make the length of the core of the arc described by the outermost side of the horsehead somewhat longer than the stroke imparted into the polish rod.

The bridle usually is connected to the polish rod by a hanger bar and rod clamp, all of which is customarily suspended below the horsehead and above the stuffing box of the well. The vertical distance required by the prior art horsehead, bridle, hanger bar, and rod clamp is of considerable length and often extends up into the air 10–15 feet.

Applicant has discovered that the maximum height of the pumpjack unit can be reduced to a value under 5 feet, by placing the pumpjack unit below ground level, and by placing the stuffing box of the wellhead below ground level, and by shortening the overall vertical height of the horsehead to a value slightly less than the length of a rod stroke so that the bridle moves laterally to and fro a small amount at each end of the stroke thereof. This unexpected phenomena enables a significant reduction in the overall vertical dimension of the horsehead.

Applicant has also discovered that a horsehead can be fabricated to enclose the rod clamp during reciprocation of the bridle and polish rod, thereby effecting still another unexpected reduction in the vertical height requirement of a pumpjack unit.

When all of the these unobvious and unexpected savings in height are accumulated, the result is a pumpjack unit of unusually low profile which finds acceptability in many locations where conventional pumpjacks were heretofore refused.

Moreover, when the above novel improvements are effected, the resultant structure provides unexpected safety features which enhance the ease with which maintenance can be effected on the pumpjack unit.

A pumpjack unit having a low profile and located partially below the surface of the earth in order to overcome the foregoing objections is the subject of the present invention.

SUMMARY OF THE INVENTION

A low profile pumpjack unit actuates a downhole pump which produces fluid from a borehole. The pumpjack unit includes a main frame which supports a Sampson post to which a walking beam is journaled, with one end of the beam being connected to a pitman arm by which the beam is rocked; and, a horsehead, made in accordance with the present invention, is attached to the other end of the walking beam.

The horsehead is made of two parallel vertically aligned, spaced plate members of substantially identical construction. Each plate member includes an outer curved track surface, an upper curved track surface, and a lower curved track surface. The outer curved track surface describes the circumference of a segment of a circle, and the circumference has a radius measured from the Sampson post journal. The upper and lower curved track surfaces are joined to the outer curved track surface by a relatively sharp bend. The cord of the segment is slightly less than the stroke of the sucker rod string, and the sharp bend eliminates excessive bending of the bridle cable at each end of the segment.

The side of the horsehead nearest the Sampson post includes a downwardly opening saddle which forms a cable anchor. The saddle receives a medial portion of the bridle cable therein, so that the remaining opposed cable lengths of the bridle cable can be brought up about the upper track means and down the outer curved track surface where the ends of the bridle cable supports the sucker rod hanger and clamp in a special and novel manner as hereinafter will be more fully described.

The pumpjack unit's main frame preferably is supported below ground level in an excavation which is separate from the borehole. The entire structure can be conveniently enclosed within a housing so that there is no danger of injury resulting from the moving parts, and the entire apparatus effectively in hidden from view, or at least is imparted with a configuration which more tastefully blends into the background.

The low profile of the apparatus enables a traveling irrigation system to pass overhead clear of the walking beam and horsehead.

Accordingly, a primary object of the present invention is the provision of a pumpjack unit which exhibits a low profile of a height which enables a traveling irrigation system to pass thereover.

Another object of the present invention is the provision of a pumpjack unit which has a horsehead and bridle combination of a configuration to enable the height of the hrosehead to be maintained unusually low.

Another and further object of the present invention is the provision of a horsehead, bridle, and polish rod support means which cooperate together to require a minimum vertical height.

Still another object of the present invention is the provision of a low profile pumpjack unit received within a cavity and a wellbore which tops out in a cellar separate from the cavity so that production of the well is maintained separated from most of the pumpjack unit.

An additional object of the present invention is the provision of a novel pumpjack apparatus which enables a method of producing a well to be carried out in an unusual manner.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
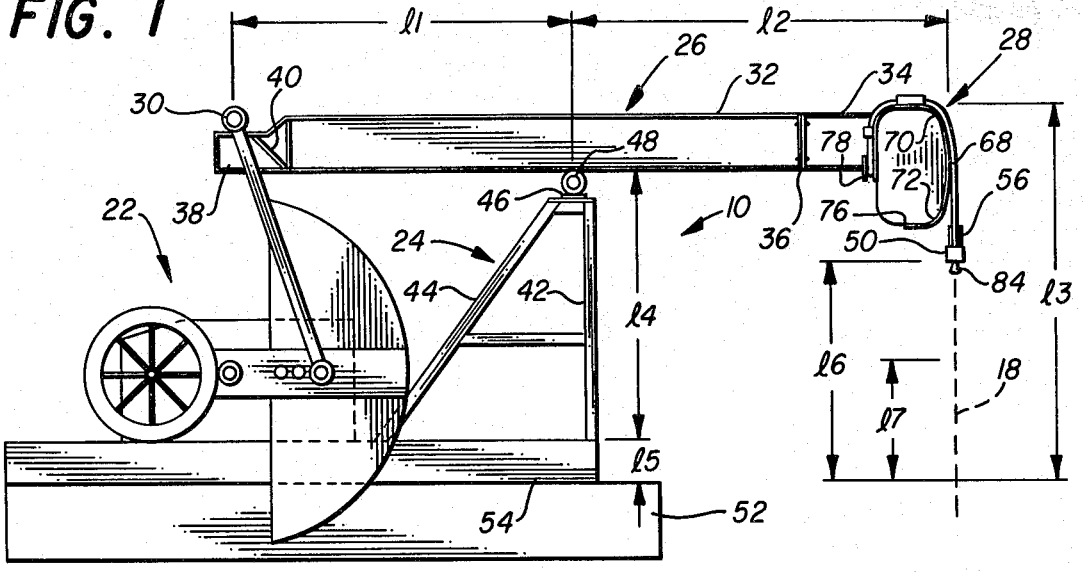
FIG. 1 is a side elevational view of a pumpjack unit made in accordance with the present invention.
Figure 2:
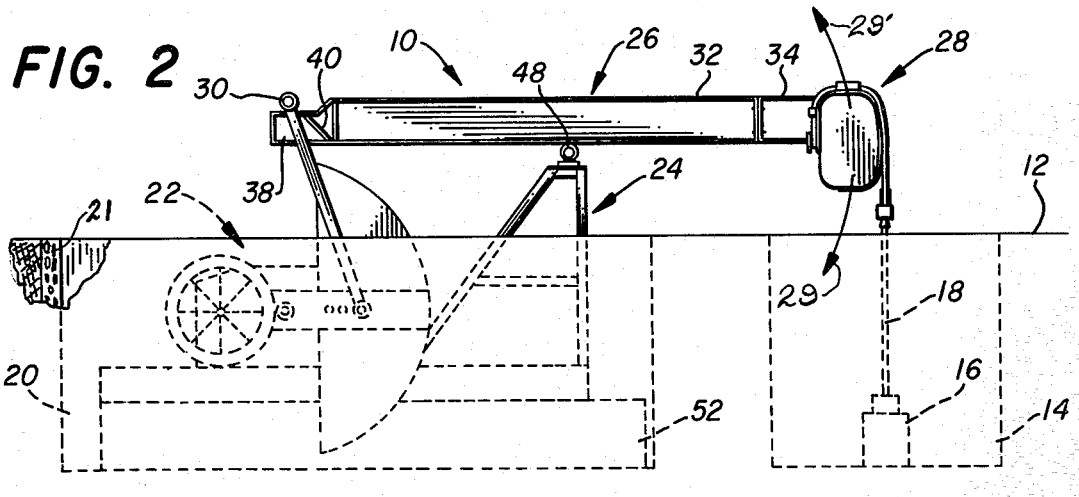
FIG. 2 illustrates the pumpjack apparatus seen in FIG. 1 mounted partially below the surface of the earth.

In FIG. 1 of the drawings, there is disclosed a low profile pumpjack unit 10 made in accordance with the present invention. As seen in FIG. 2, parts of the pumpjack are supported below the surface 12 of the earth. A cellar 14 receives a wellhead 16 therewithin which forms the upper terminal end of a borehole. The wellhead is provided with the illustrated packing box for sealingly receiving a reciprocating polish rod 18 located at the upper end of a string of sucker rod (not shown). A cavity 20 is formed into the ground in spaced relationship to the wellbore.

As seen in both FIGS. 1 and 2, the pumping apparatus includes a gear box 22 which turns a pair of cranks for imparting reciprocatory motion into a pitman arm in the usual manner. An upright Sampson post 24 is rigidly supported from the illustrated main frame for supporting a medial portion of a rocking or walking beam 26 in journaled relationship therewith.

A horsehead 28, made in accordance with the present invention, is attached to and forms one terminal end of the rocking beam, while the pitman arm is journaled at 30 to the other end of the rocking beam.

The horsehead preferably is rigidly attached to a short length of a beam 34, and thereby becomes part of one marginal end of the rocking beam. Bolt flange 36 is mated with a complimentary bolt flange provided at the terminal end of the walking beam so that the horsehead can be changed from one walking beam to another, or retrofitted to an existing pumpjack unit.

Numeral 38 indicates the end of the walking beam which is opposite to the hrosehead. The marginal terminal end is stepped down at 40 to reduce the height of the structure when end 38 is elevated by the pitman arm.

The Sampson post preferably is made of laterally spaced upright channel members 42 together with laterally spaced diagonal channel members 44 which rigidly affix a bearing plate member 46 in elevated relationship respective to the main frame. The Sampson post bearing 48 is fastened to the plate member and supports the oscillating walking beam in low friction relationship therewith.

A hanger bar 50 supports a polish rod clamp 56 from the horsehead by means of a cable loop comprised of cable lengths 66 and 68.

A concrete pad 52 can be placed within the bottom of the cavity so that negligible movement occurs between frame member 54 and the ground.

Figure 3:
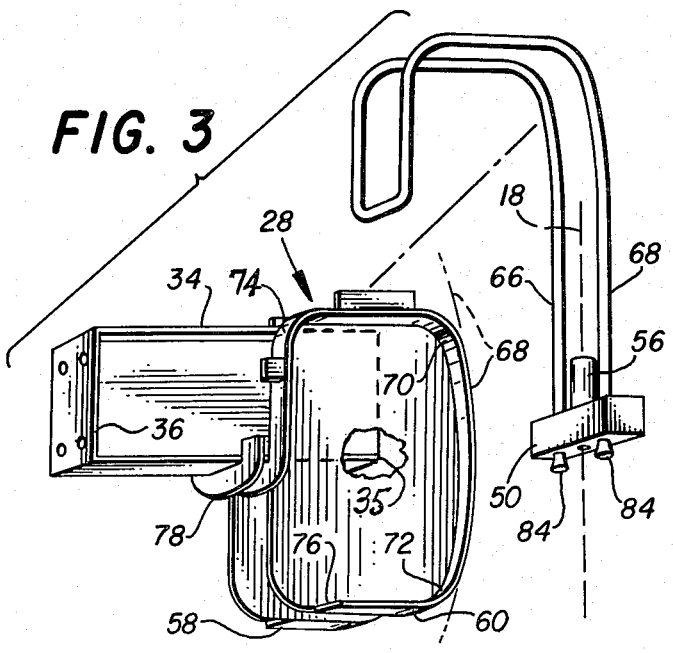
FIG. 3 is an enlarged detail of part of the pumpjack apparatus disclosed in FIGS. 1 and 2; and, FIG. 4 is a front view of a pumpjack apparatus made in accordance with the present invention.
Figure 4:
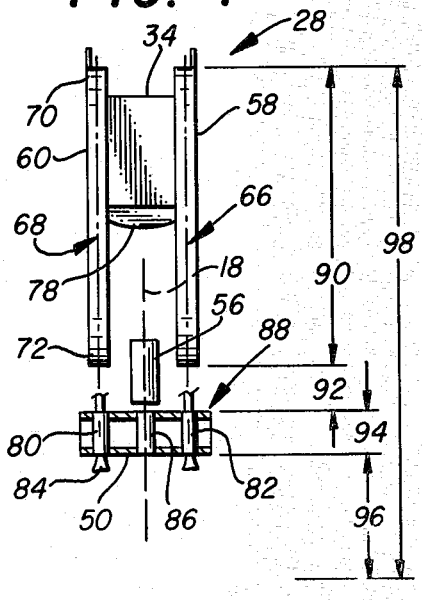

As seen in FIG. 3, the polish rod clamp 56 is bottom supported by the hanger bar 50. As seen in FIG. 4, the horsehead is comprised of spaced parallel vertically aligned members which are rigidly connected to opposed sides of one end of the walking beam. The outermost end of the horsehead has spaced cable receiving tracks 58 and 60 formed thereof which receive cable lengths 66 and 68 in the illustrated manner of FIG. 4 thereon. Numerals 66' and 68' generally illustrate the centerline of the bridle cable respective to the tracks.

The track receives a sharp bend at 70 and curves towards the Sampson post to form the upper end of the horsehead; and, a sharp bend at 72 and curves back towards the Sampson post to form the lower end of the horsehead. As seen in FIG. 3, the track at the lower end of the horsehead terminates at 76 in spaced relationship respective to a downwardly opening saddle 78.

The hanger bar includes passageways formed by cylinders 80 and 82 which receive the opposed marginal ends of the cable therethrough. The cables can be separated and flared out as indicated by numeral 84, whereupon the ends of the cable are soldered or babitted and thereby become secured to the hanger bar. The polish rod clamp 56 is supported from the upper face 88 of the cross bar.

Numeral 90 indicates the effective length of the track surface, numeral 92 indicates the distance between the lowermost end of the horsehead and the upper face 88 of the hanger bar, numeral 94 illustrates the height of the hanger bar, while numeral 96 indicates the distance between the bottom of the hanger bar and the top of the polish rod stuffing box located on top of the wellhead. Numeral 98 is the sum total of the length of the elements associated with numerals 90–96.

In FIG. 1, with the pumpjack walking beam in the neutral position, L1 indicates the length of the walking beam located between the pitman journal 30 and the Sampson post journal 48. The length L2 is the distance measured between the outer rail and the Sampson post bearing. The vertical height L3 indicates the vertical distance measured from the top of the stuffing box to the top of the horsehead. The length L4 is the vertical distance from the top of the main frame to the lower face of the walking beam. The main frame has a thickness L5 while L6 is the distance of the hanger bar above the stuffing box.

In operation, a cellar is excavated about the wellhead of a size to accommodate the horsehead. In the preferred embodiment of the present invention, a cavity 20 is formed in spaced relationship to the wellhead, thereby leaving the dangerous wellhead isolated from the motor and drive train of the pumpjack unit. The cellar and cavity can be provided with masonry walls, such as concrete.

The pumpjack unit is properly aligned with the wellhead in order to bring the polish rod and bridle cable into alignment with the axial centerline of the borehole and tangently respective to the outer track face at 68. An important feature of the present invention is the relationship between the hanger bar, sucker rod clamp, and horsehead, it being noted that the hanger bar upper surface is brought into close proximity to the lowermost track member of the horsehead, while the rod clamp 56 is received between the two opposed track supporting members of the horsehead.

The bridle preferably is a single length of cable having the ends babbitted to support the hanger bar therefrom so that a medial portion of the bridle can be received within the saddle 78, and the two bridle cable lengths brought up track 74, about the upper track portion 70, and back down the two parallel outer tracks 58 and 60, as noted at 66' and 68' in FIG. 4.

The distance 90 measured between the upper and lower track members is maintained almost equal to the length of the stroke of the polish rod, that is, the cord of the segment of the circle described by the outer track member is slightly less than the actual stroke imparted into the polish rod by the bridle. It has been found that this ratio will impart very little fore and aft movement into the bridle as the bridle cable leaves the front track member as it commences to separate from the horsehead at the upper and lower sharp track bends.

The circumference 68 of the outer track member preferably is drawn by a radius which extends from the Sampson post journal to the outer face of the track means.

The top of the horsehead is maintained in a relative low position respective to the top of the end 34 of the walking beam so that the tallest structure associated with the pumpjack unit is positioned at the lowest possible elevation. By placing the pumpjack unit within a cavity, and separating the cavity from the well-bore, the horsehead can be extended into the cellar of the well-bore as it is oscillated by the pitman arm. The present invention achieves a low profile pumpjack unit having a conventional stroke; while at the same time, the tallest part of the uppermost structure of the working pumpjack unit is always less than five feet above ground level. Moreover, a small housing less than five feet in height can be used to enclose both the pumpjack unit and the wellhead so that there is no danger from anyone tampering with the mechanism and becoming injured.

Another unforeseen advantage of providing a cavity separated from the wellhead cellar is that dangerous gases which accumulate at the wellhead will not be encountered by workmen who must service the equipment. Danger of poison gas and explosive hydrocarbons are greatly reduced by the present invention.

The details of the horsehead in combination with the bridle and hanger bar provide a pumpjack unit having a minimum height and which can be placed partially below the surface of the earth and operated in a cavity separated from the wellhead cellar; with the motor, gear box, and Sampson post being supported within the cavity while the horsehead reciprocatingly enters the borehole cellar to thereby provide a new type structure for producing oilwells.

The modern day horsehead requires that the stuffing box be located about two and one-half times the length of the stroke below the maximum height of the pumping unit. The present invention requires that the stuffing box be located only about one and a half times the length of the stroke below the maximum height of the pumping unit.

The unique design of the present horsehead enables the rod clamp to be received within the horsehead at a location above the lower end of the sides of the horsehead.

The combination of the horsehead, rod clamp, together with the manner in which the pumpjack unit is supported within a cavity with the horsehead reciprocating or oscillating into the wellhead cellar, enables the pumpjack unit to use a 54" stroke, for example, with the stuffing box being located only 30" below ground level, and wherein the height of any part of the operating unit never exceeds five feet above ground level.

I claim:

1. In a low profile pumpjack unit for reciprocating a string of sucker rod connected to a downhole pump, said pumpjack unit includes a main frame which supports an upright Sampson post; a walking beam journaled to the Sampson post and rocked by a pitman arm connected at one end thereof, and a horsehead located at the other end thereof; and a bridle attached to the horsehead which is connected to reciprocate a polish rod which extends through a stuffing box and reciprocates the sucker rod string, the improvement comprising:

said horsehead comprises two parallel vertically aligned spaced plate members which are mirror images of one another and of substantially identical geometrical configuration;

each plate member includes an outer curved track surface, an upper track surface, and a lower curved track surface;

said outer curved track surface is a segment of a circle having a radius measured from the Sampson post journal, said upper and lower track surfaces are joined to the outer curved track surface by a relatively sharp bend; the chord of the segment of a circle which forms said outer track member is slightly less than the stroke of the sucker rod;

a downwardly opening bridle receiving saddle located on the lower surface of the far end of the walking beam and adjacent to the near end of the plate members which form the horsehead, a bridle located on the track surface, said bridle has a medial length thereof received within the saddle and the remaining opposed marginal ends of the bridle are roved from the downwardly opening saddle, upwardly across the upper track member and back down the outer track member where the bridle ends are connected to a hanger bar, said hanger bar is closely spaced in underlying relationship respective to the lower side of the two spaced members;

a polish rod clamp is received between the bridle ends and within the spaced members, thereby providing a minimum requirement for height between the lower end of the horsehead and the upper end of the polish rod.

2. The pumpjack of claim 1 wherein said horsehead is connected to said rocking beam by a bolt flange so that the horsehead can be retrofitted to the walking beam of a number of different pumpjack units.

3. The pumpjack of claim 2 wherein the upper end of the hanger bar is brought into close proximity of the lower end of the horsehead, and the lower end of the hanger bar is brought into close proximity of the stuffing box during reciprocation of the pumpjack unit; and, the upper end of the horsehead is positioned closely adjacent to the upper surface of the rocking beam so that very little of the horsehead extends above the plane of the upper surface of the rocking beam.

4. A low profile pumpjack unit for reciprocating a string of sucker rod which extends through a stuffing box of an oilwell and is connected to reciprocate a downhole pump, said pumpjack unit includes a main frame which supports an upright Sampson post; a walking beam journaled to the Sampson post and rocked by a pitman arm connected to one end thereof, a horsehead located at the other end thereof; and a bridle attached to the horsehead, in combination:

said bridle is connected to reciprocate a polish rod which in turn reciprocates the sucker rod string for the downhole pump;

said horsehead comprises two aligned bridle receiving members which are mirror images of one another and of substantially the same geometrical configuration;

each bridle receiving member includes an upper track member and further includes an outer curved track surface which describes a segment of a circle having a radius measured from the Sampson post journal, with the chord of the segment of a circle which forms said outer track member being slightly less than the stroke of the polish rod;

means forming a downwardly opening saddle located at the lower surface of the far end of the walking beam and adjacent to the near end of the plate members;

a hanger bar, a polish rod clamp, said bridle supports said hanger bar in close proximity of the lower surface of said horsehead, said clamp is attached to said polish rod and is supported by said hanger bar and is received between the bridle receiving members of the horsehead to thereby position the top of the horsehead a minimum distance from the top of the stuffing box;

said stuffing box is attached to the wellhead, said wellhead terminates within an upwardly opening cellar; and, the pumpjack is supported within an upwardly opening cavity such that the horsehead reciprocates into and out of the cellar, thereby locating the entire pumpjack unit at a very low elevation;

said bridle is roved from the downwardly opening saddle, upwardly across the upper track member and back down the outer track member where the bridle ends are connected to the hanger bar, said hanger bar is closely spaced in underlying relationship respective to the lower side of the two spaced members;

said polish rod clamp is received between the bridle ends and within the spaced members, thereby providing a minimum requirement for height between the lower end of the horsehead and the upper end of the polish rod;

wherein the upper end of the hanger bar is brought into close proximity of the lower end of the horsehead, and the lower end of the hanger bar is brought into close proximity of the stuffing box; and, the upper end of the horsehead is positioned closely adjacent to the upper surface of the rocking beam so that very little of the horsehead extends above the plane of the upper surface of the rocking beam.

* * * * *